US007445279B2

(12) United States Patent
Crum

(10) Patent No.: US 7,445,279 B2
(45) Date of Patent: Nov. 4, 2008

(54) PIVOT-OVER-ARM RECLINING MECHANISM FOR A SEATING UNIT

(75) Inventor: Michael Andrew Crum, Mantachie, MS (US)

(73) Assignee: L & P Property Management Company, South Gate, CA (US)

( * ) Notice: Subject to any disclaimer, the term of this patent is extended or adjusted under 35 U.S.C. 154(b) by 60 days.

(21) Appl. No.: 11/558,983

(22) Filed: Nov. 13, 2006

(65) Prior Publication Data

US 2008/0111402 A1 May 15, 2008

(51) Int. Cl.

| | |
|---|---|
| ***A47C 1/02*** | (2006.01) |
| ***A47C 1/022*** | (2006.01) |
| ***A47C 1/024*** | (2006.01) |
| ***A47C 1/034*** | (2006.01) |
| ***A47C 1/035*** | (2006.01) |

(52) U.S. Cl. ..... 297/84; 297/68; 297/69; 297/85

(58) Field of Classification Search ..... 297/68, 297/69, 84, 85

See application file for complete search history.

(56) References Cited

U.S. PATENT DOCUMENTS

| | | | | | |
|---|---|---|---|---|---|
| 4,113,305 | A | * | 9/1978 | Hampton | 297/69 |
| 4,212,495 | A | * | 7/1980 | Gall | 297/84 |
| 4,506,925 | A | * | 3/1985 | Crum | 297/69 |
| 4,577,902 | A | * | 3/1986 | Crum | 297/85 |
| 4,662,673 | A | * | 5/1987 | Crum | 297/68 |
| 5,141,284 | A | * | 8/1992 | LaPointe | 297/85 |
| 5,147,108 | A | * | 9/1992 | LaPointe | 297/85 |
| 5,156,441 | A | * | 10/1992 | Byersmith et al. | 297/85 X |
| 5,192,113 | A | * | 3/1993 | Wiecek | 297/85 |
| 5,217,276 | A | * | 6/1993 | LaPointe et al. | 297/85 |
| 5,271,660 | A | * | 12/1993 | LaPointe et al. | 297/85 |
| 5,292,170 | A | * | 3/1994 | LaPointe et al. | 297/85 |
| 5,527,095 | A | * | 6/1996 | Marshall et al. | 297/84 X |
| 5,570,927 | A | * | 11/1996 | LaPointe et al. | 297/85 |
| 5,975,627 | A | * | 11/1999 | LaPointe et al. | 297/68 |
| 5,992,930 | A | * | 11/1999 | LaPointe et al. | 297/68 |
| 6,135,559 | A | | 10/2000 | Kowalski | |
| 6,145,924 | A | * | 11/2000 | Mero et al. | 297/68 |
| 6,231,120 | B1 | * | 5/2001 | Wiecek | 297/84 |
| 6,409,262 | B1 | * | 6/2002 | LaPointe | 297/68 |
| 6,557,934 | B2 | * | 5/2003 | Wiecek | 297/84 |
| 6,637,813 | B2 | * | 10/2003 | Wiecek | 297/84 |
| 6,644,733 | B1 | | 11/2003 | Tseng | |
| 6,793,279 | B2 | | 9/2004 | Hoffman et al. | |

(Continued)

*Primary Examiner*—Rodney B. White
(74) *Attorney, Agent, or Firm*—Shook, Hardy & Bacon, L.L.P.

(57) ABSTRACT

A seating unit has a pair of arms that reach to the floor or may be supported by high legs. The arms are attached to a reclining mechanism that is moveably attached to an ottoman, a back, and a seat. The reclining mechanism has an ottoman linkage and a sequence linkage, wherein the ottoman linkage extends the ottoman forward from a closed to a TV position. The ottoman linkage has drive location slightly above an over-center axis when in closed position and directs occupant weight to retract the linkage, but directs weight to extend the linkage when drive location passes through the axis. The sequence linkage has a back arm with an arcuate slot that slidably engages a pin on the ottoman linkage. The pin restricts the back arm from rotating in closed position and the ottoman linkage from retracting when the back is reclined.

9 Claims, 7 Drawing Sheets

U.S. PATENT DOCUMENTS 6,945,599 B2 9/2005 May
7,011,362 B1 3/2006 Huang
7,114,770 B2 10/2006 Murphy
7,147,278 B2 * 12/2006 Johnson et al. ..... 297/85
2006/0249993 A1 * 11/2006 Rogers ..... 297/68
2007/0046075 A1 * 3/2007 Johnson et al. ..... 297/85
2007/0158980 A1 * 7/2007 LaPointe et al. ..... 297/84
2007/0241589 A1 * 10/2007 LaPointe ..... 297/85
2008/0012396 A1 * 1/2008 Hoffman et al. ..... 297/85

* cited by examiner

PIVOT-OVER-ARM RECLINING MECHANISM FOR A SEATING UNIT

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved reclining mechanism developed to accommodate a wide variety of styling for a seating unit which is otherwise limited by the configurations of recliner mechanisms in the field.

Reclining seating units exist that allow a user to forwardly extend a footrest and to recline the chair back relative to the seat. These existing seating units typically provide three basic positions: a normal non-reclined sitting position with the seat generally horizontal and the back substantially upright; a partially reclined position often referred to as a "TV" position wherein the seat and back are disposed in a slightly reclined position but with the back still sufficiently upright to permit comfortable television viewing from the chair; and a fully reclined position wherein the back is pivoted toward horizontal into an obtuse relationship with the seat for lounging or sleeping. Most reclining seating units include a footrest coordinated with the mechanical arrangement to be extended forwardly of the seat in the TV and fully reclined positions.

There are a number of reclining mechanisms in the industry that include the reclining capability and offer certain design capabilities to the furniture manufacturer. However, these reclining mechanisms are relatively complex and to some extent impose constraints on an upholstery designer's use of multiple styling features concurrently into a reclining seating unit. One specific feature is a space saving utility that cures a disadvantage of many traditional seating units, wherein the back in the fully reclined position will contact an adjacent wall unless the base is moved outwardly away from the wall. However, present seating units that incorporate the space saving utility have reclining mechanisms using linkages that reach from the arms to a base on the floor to accomplish this feature. As such, these seating units with existing recliner mechanisms are precluded from providing both a pivot over arm feature, and arms that rest either directly on the floor or supported by high legs. Other existing seating units provide a combination of wing back seats that pivot over the arm and high legs but their linkage structure precludes providing a T-cushion seat design. Still other existing seating unit configurations allow both T-cushion and wing backs that pivot over the arm. However, these seating units require bulky complex reclining mechanisms that restrict the incorporation of a high leg feature that requires a compact mechanism residing between the leg tops and the seat. As such, upholstery designers are forced to choose between styling options. Moreover, upholstery styling designers are forced to purchase and stock many different recliner mechanisms if each option is to be produced within the seating unit line.

The present invention pertains to a novel recliner mechanism that allows a seating unit to provide all of the following features: a T-cushion seat, a wing chair back that pivots over the arms, a space-saving utility, an arm to floor feature, and high leg capability. Significantly, the mechanism of the invention is constructed so that the reclining mechanism is simple and compact such that it can provide function without impairing incorporation of desirable upholstery features. Further, the present invention allows for a wide variety of styling options that may be applied to a seating unit.

BRIEF SUMMARY OF THE INVENTION

Accordingly, the present invention seeks to provide a simplified, compact, recliner mechanism which can be adapted to essentially any type of seating unit.

A typical seating unit has a base with opposed arms with side arm brackets, a seat extending between the arms, a back, and an ottoman. The side arm brackets each have a generally vertical back support section.

The reclining mechanism of the present invention is disposed between the opposed arms and connected to the side arm brackets. This allows the opposed arms to either rest directly on an underlying surface or to be supported by legs, wherein the legs may be low, mid or high legs. The reclining mechanism includes seat rails connected to the seat, an ottoman linkage assembly, a drive link, an over-center lever, a drive lever, and a sequence assembly. The seat rails are pivotably coupled on a forward end to a respective side arm bracket.

The ottoman linkage assembly couples the seat rail and the ottoman. The ottoman linkage assembly is adapted to move the ottoman from a closed position with the ottoman generally vertical and beneath the seat, to an extended position with the ottoman generally horizontal and forward of the seat. The drive link has a first end pivotably coupled to the seat rail at an upper pivot and has a drive attachment location below the upper pivot. The drive link also has a second end pivotably coupled to the ottoman linkage assembly. The over-center link has a first end pivotably coupled to the drive link at the drive attachment location and has a second end opposite the first end. The second end has a lower pivot point, wherein the upper pivot and lower pivot point define an over-center axis. The drive lever is pivotably attached to the seat rail and has an upper portion adapted to be actuated by a user, and a lower portion pivotably attached to the drive link and the over-center link at the drive attachment location. The ottoman linkage includes an extension-resistant mechanism that has a forward and rearward end and is coupled to the seat rail at the forward end and to the drive link at the rearward end. The extension-resistant mechanism may be a tension spring, a gas cylinder, or any other extension-resistant mechanism which is well-known in the furniture manufacturing industry.

In use, the drive lever can be pivoted to translate the drive attachment location through the over-center axis, but is resisted by the extension-resistant mechanism. Rotation of the drive lever enables movement of the drive link, triggering movement of the ottoman linkage assembly and moving the ottoman between the closed and extended position. This configuration enables the seat to be formed as a T-cushion.

The sequence assembly couples the back to the opposed arms. The sequence assembly has a pair of back arms, each has a first end coupled to the back, and a second end that has an arcuate slot with upper and lower ends. Each back arm is pivotably coupled at a back pivot to the vertical back support section of a respective side arm bracket. In addition, each arm is coupled to a respective seat rail by a pin extending from the seat rail and through the slot.

In use, the pin is positioned in the upper end of the slot when the seating unit is in the closed position, restraining rotation of the back arm about the back pivot. The pin is positioned in the lower end of the slot when the seating unit is in the extended position, allowing rotation of the back arm about the back pivot to the reclined position. The pin is captured in the lower end of the slot when the seating unit is in the reclined position, restraining movement back to the closed position. This configuration allows the back to rotate over the opposed arms, so a wing-style back may be used in the design. Additionally, the high pivot back arm configuration provides a space-saving utility, allowing the chair to be placed in relatively close proximity to a wall.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
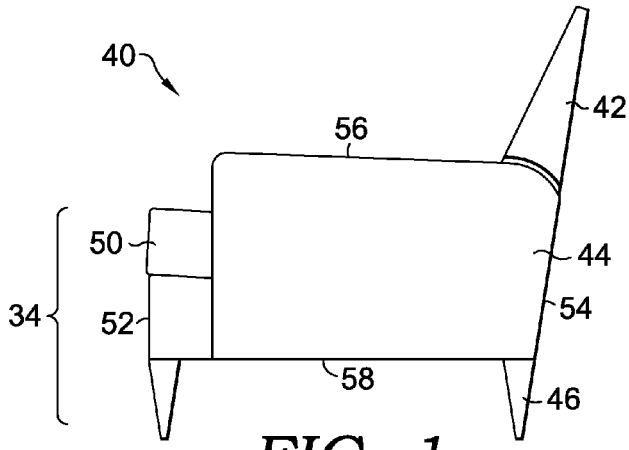
FIG. 1 is a diagrammatic lateral view of a seating unit in a closed position.
Figure 2:
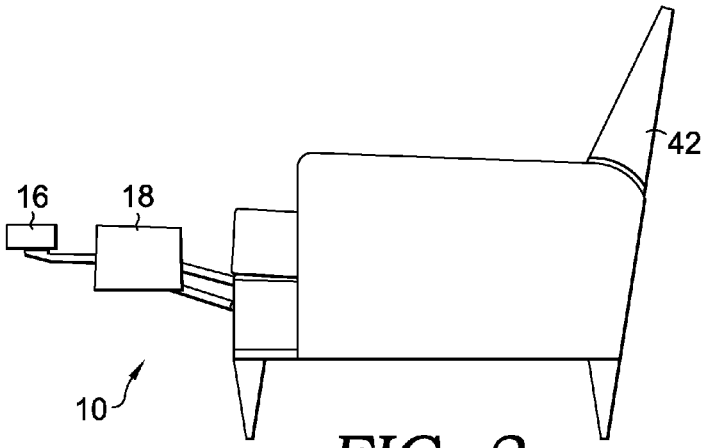
FIG. 2 is a view similar to FIG. 1, but in a TV position.
Figure 3:
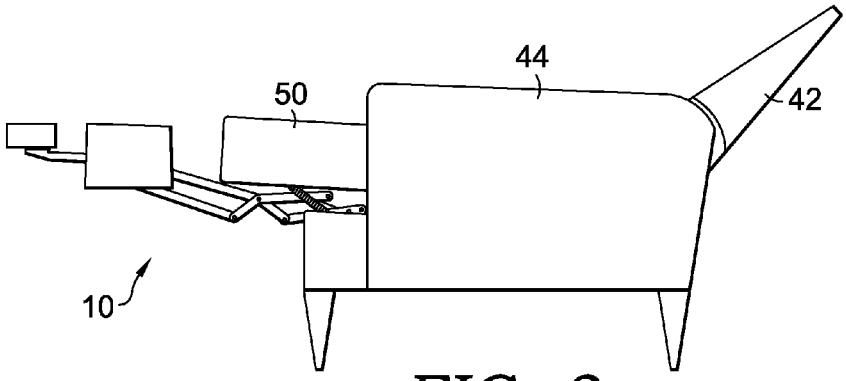
FIG. 3 is a view similar to FIG. 1, but in a fully reclined position.

FIGS. 1-3 illustrate a reclining seating unit 40. Reclining chair 40 has a seat 50, a back 42, legs 46, a recliner mechanism 10, a foot support ottoman 16, a leg support ottoman 18, and a stationary base 34. Stationary base 34 has a front 52, a back 54, and a pair of side arms 44. Side arms 44 are laterally spaced and have an upper arm portion 56 and a lower arm portion 58. Stationary base 34 supports the seat 50 on a seating support surface (not shown) that is disposed between the pair of opposed side arms 44, and the back 42. Back 42 extends from the back 54 of the stationary base 34 and is pivotably coupled to the recliner mechanism 10 near the upper arm portion 56. Legs 46 support the stationary base 34 and raise it above an underlying surface (not shown). Foot support ottoman 16 and leg support ottoman 18 are moveably supported by the recliner mechanism 10. The recliner mechanism 10 is arranged to articulably actuate and control movement of the seat 50, the back 42, and the ottomans 16, 18 between the positions shown in FIGS. 1-3, as more fully described below.

As shown in FIGS. 1-3, the reclining chair 40 is adjustable to three basic positions. FIG. 1 depicts a closed position, which is a normal non-reclined sitting position with the seat cushion 50 in a generally horizontal position and the back 42 substantially upright. In the closed position, the ottomans 16, 18 are positioned below the seat 50. FIG. 2 depicts a TV position, or extended position in which the leg support ottoman 18 and the foot support ottoman 16 are extended forward of the front 52 of the seating unit 40 and disposed generally horizontal. In the TV position, the back of seat 50 is rotated downwardly in relation to the front of seat 50 at a pivot near the front 52. The rotation of the seat 50 is independent of back 42 and side arms 44. This allows a T-cushion style of seat cushion for seat 50. Generally, the T-cushion extends forward between the front 52 and sides arms 44 of the reclining chair 40 such that the front of the cushion is not held between arms 44. Further, in the TV position, the angle of inclination of back 42 remains unchanged, and will not encroach an adjacent wall. Thus, the configuration gives the user a reclined TV position while providing a space saving utility. FIG. 3 depicts a fully reclined position in which the seat 50 and ottomans 16, 18 have moved forward and upward. In the fully reclined position, the back of seat 50 is rotated downwardly in relation to the TV position, and the back 42 is rotated over the upper arm portion 56 in a rearward inclination angle. The rearward inclination angle of the fully reclined position causes the back 42 to move rearwardly to some degree. However, the rearward movement is minimized such that the back 42 moves only around six inches rearwardly from the back 54. This is in contrast to other reclining chairs with 3-position mechanisms, which cause a backrest to move rearward around eighteen inches. Thus, the combination of the rotation of the back 42 over the upper arm portion 56, and the forward movement of the seat 50 provide for a second space saving utility of the present invention.

Figure 4:
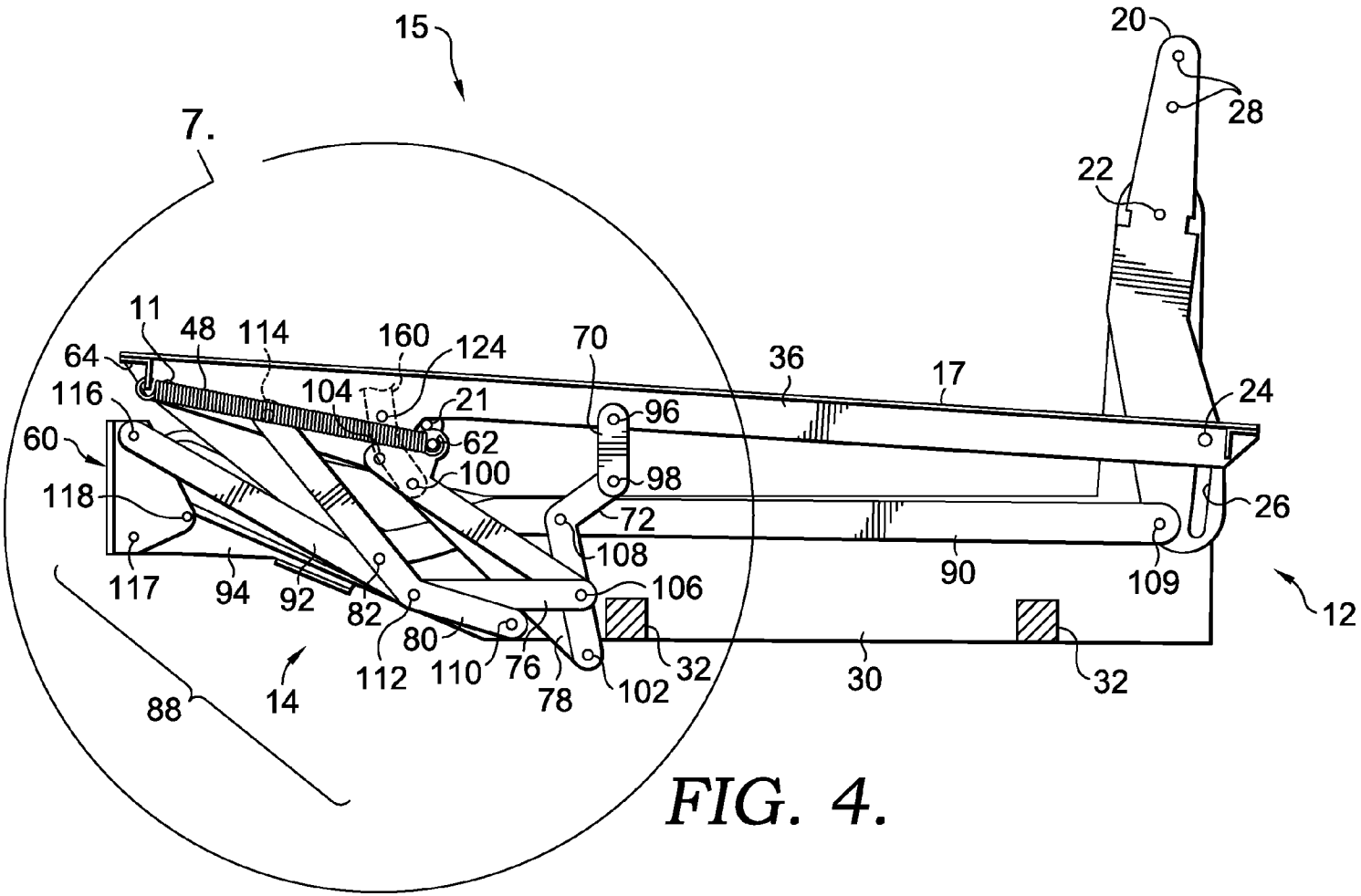
FIG. 4 is a side elevation view of a recliner mechanism in a closed position.
Figure 6:
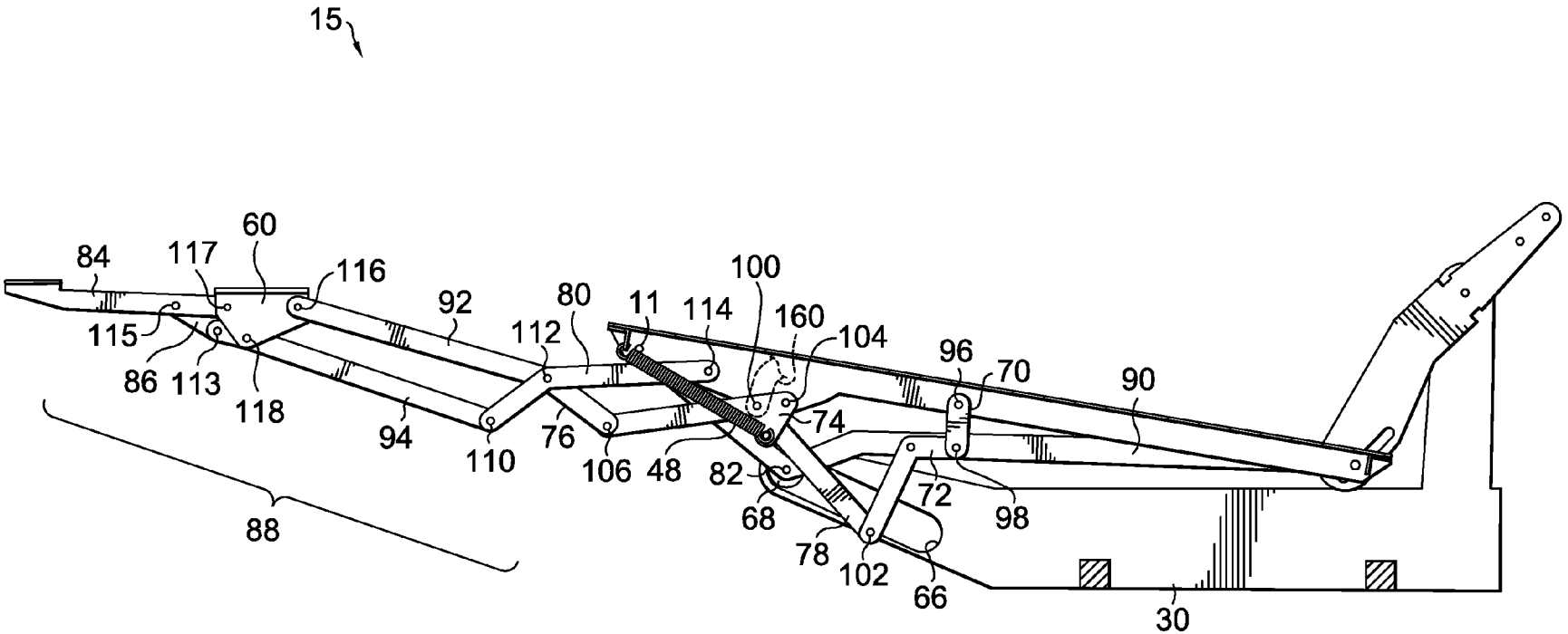
FIG. 6 is a view similar to FIG. 4, but in a fully reclined position.

Turning to FIG. 4, the recliner mechanism 10 comprises two essentially mirror-image recliner structures 15 respectively mounted in opposing facing relation. Recliner structure 15, illustrated in FIG. 4 in a side elevation view, broadly includes a footrest linkage assembly 14, a sequence guide assembly 12, a seat rail 36, a carrier bracket 90, and a roller 68 (FIG. 6). The recliner structures 15 are supported on chair 40 through a pair of side arm brackets 30 and transverse members 32. Two transverse members 32 are depicted in cross-section and are arranged substantially perpendicular to the side arm brackets 30. Transverse members 32 are made from a generally rigid material, such as square steel tubing or square stock, and generally extend between the opposed arms brackets 30. The transverse members 32 are fixedly connected to each opposed side arm bracket 30 at each end. The brackets 30 are in turn coupled to arms 44. An exemplary embodiment of the side arm bracket 30 attachment to the side arm 44 is a wedge-lock KD (knock down) arm that provides for assembly of additional seats to a seating unit. Each of the side arm brackets 30 supports a respective mirror-image recliner structure 15 and allows the seat 50, ottomans 16, 18 and back 42 to move relative to the base 34.

Each side arm bracket 30 is generally L-shaped with a front section having an inclined slot 66 formed therein, as best seen in FIG. 6. The roller 68 fits within the slot 66 and slidably couples the recliner structure 15 to the arm 30. The rear section of each arm 30 has a generally vertical section that allows rotatable attachment of a back arm 20 at a pivot point 22. As set forth in more detail below, the recliner structure 15 is thus coupled to a respective side arm bracket 30 at the back pivot 22, and slidably coupled to the side arm bracket 30 at slot 66 with the roller 68 (FIG. 6).

As would be understood by those of skill in the art, back 42 is coupled to arm 20. Exemplary embodiments of the back 42 attachment to the arm 20 are a KD (knock down) connection, a ready to assemble (RTA) connection, or any other suitable fasteners which are well known in the furniture manufacturing industry. Holes 28 are shown that can be used to attach back 42 to arm 20, it being understood that other attachment methods could be used.

As shown in FIG. 4, the sequence guide assembly 12 includes a back arm 20, a pin 24, and an arcuate sequence slot 26. Back arm 20 has an upper part, a central portion, and a lower part. The upper part includes the mounting holes 28. The back pivot 22 is located in the central portion and pivotably couples the back arm 20 to the side arm bracket 30. The lower part has the sequence slot 26 formed therein. A carrier bracket 90 is pivotably coupled to the back arm 20 at pivot point 109. Carrier bracket 90 extends forwardly from point 109 to the front of seat rail 36, and is pivotably connected to rail 36 at pivot 11. Intermediate pivot 11 and 109, bracket 90 is coupled to roller 68 with an axle 82. A pin 24 slidably couples the arm 20 to the seat rail 36. Pin 24 is fixedly connected to a rearward end of the seat rail 36. Pin 24 extends through slot 26, and is held within the slot. As set forth below, pin 24 resides in an upper end of the slot when the chair is in the closed position and a lower end of the slot 26 when the chair is in the TV and fully reclined positions. The sequence slot 26 guides the seat rail 36 downwardly as the chair is moved from the closed position to the fully reclined position.

As shown in FIGS. 4-7, the footrest linkage assembly 14 includes a seat pivot link 70, a seat lowering link 72, an over-center link 78, an upper drive link 74, a lower drive link 76, an actuator lever 160, a tension device 48, and a forward linkage structure 88. The links 70, 72, 74, 76, and 78, as well as the links described below in structure 88, are formed from a sturdy material, such as stamped, formed steel. It should be understood that other suitable materials could also be used. Seat pivot link 70 is pivotably coupled at its upper end to a generally central portion of the seat rail 36 at pivot 96 and extends substantially downward. The pivotable couplings such as pivot 96 may be made by pins, rivets, bearings, bolts, or any other suitable fasteners which are well known in the furniture manufacturing industry.

The lower end of link 70 is pivotably coupled to an upper end of seat lowering link 72 at pivot 98. The lower end of link 72 is coupled to the lower end of the over-center link 78 at pivot 102. Additionally, a central portion of the seat lowering link 72 is pivotably coupled to the carrier bracket 90 at pivot 108. An upper end of the over-center link 78 is coupled to an upper end of the upper drive link 74 and a lower end of the actuator lever 160 at a drive location 100. Actuator lever 160 is also pivotably coupled at a central portion to the seat rail 36 at pivot 124. As described below, an upper end of the actuator lever 160 is positioned for operation by a user, or seat occupant, to adjust the reclining chair 40 from the closed to TV position.

At a pivot 104, immediately above the drive location 100, an upper end of the upper drive link 74 is coupled to the seat rail 36. Drawing a straight line from a center point of pivots 102 and 104 creates and over-center axis 150 (FIG. 7), the importance of which is described below.

The tension device 48 is pivotably coupled at a rearward end to a rearward spring couple 62 located on the upper drive link 74 immediately above and rearward of pivot 104 when in the closed position. The opposite end of tension device 48 is coupled to a bracket 64 that is attached to seat rail 36. The rails 36 may be formed with extending tabs 17, and the bracket 64 may be attached to this tab. In this configuration, the tension device 48 creates a counter-clockwise (as viewed in FIGS. 4-7) torque on the upper drive link 74 about pivot 104. However, counter-clockwise rotation is prevented by an upper stop 21 attached to seat rail 36. The stop 21 contacts and contains the upper end of the upper drive link 74. However, in the TV and fully reclined positions, the rearward spring couple 62 is moved forward and lower in position relative to pivot 104, bringing the upper drive link 74 off the upper stop 21. The preferred embodiment of the tension device 48 is a tension spring as shown in FIGS. 4-9, however, other biasing mechanisms could be used as well.

Figure 7:
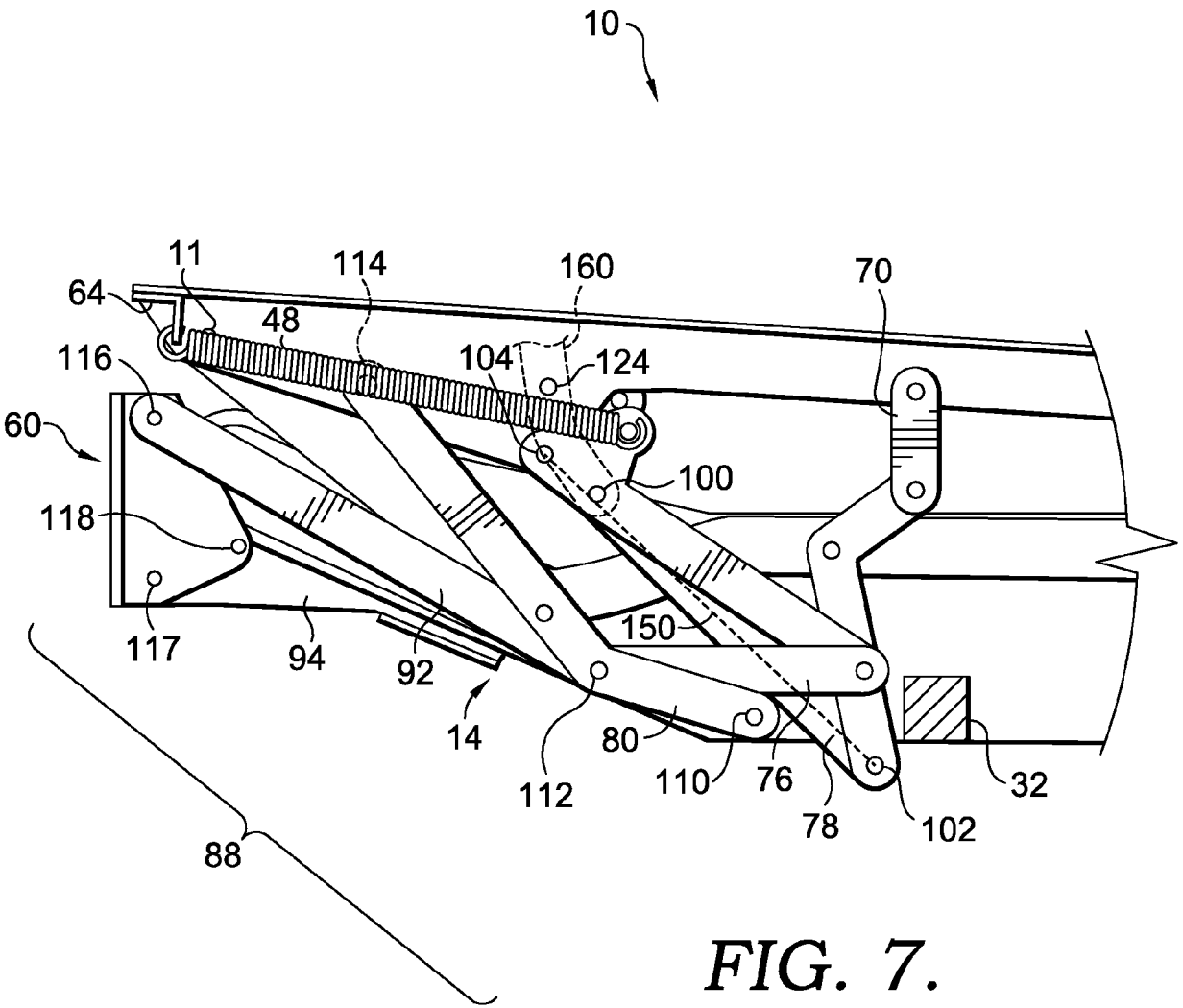
FIG. 7 is an enlarged partial side elevation view of the circled region of FIG. 4, showing an over-center axis of a footrest linkage assembly.

Returning to upper drive link 74, as seen in FIG. 7, the lower end of link 74 is coupled to a rearward end of the lower drive link 76 at pivot 106. Lower drive link 76 extends forward and is coupled at its forward end to the forward linkage structure 88 at pivot 112.

As best shown in FIG. 6, the forward linkage structure 88 includes an extension arm 80, an upper support link 92, a lower support link 94, a footrest bracket 60, an extension link 86, and a footrest link 84. The forward linkage structure 88 thus includes pivotably interconnected links driven by the links 74, 76 that extend the ottomans 16, 18 forward to a generally horizontal position. More specifically, the extension arm 80 is coupled at a center portion to the forward end of lower drive link 76 and a rearward end of the upper support link 92 at pivot 112. Links 76 and 92 may be integrally formed as one link. Extension arm 80 is pivotably coupled at an upper end to the seat rail 36 at pivot 114, and at a lower end to a rearward end of the lower support link 94 at pivot 110. In a preferred embodiment, during the adjustment of the reclining chair 40 from closed position to TV position, the extension arm 80 rotates about pivot 114 at least ninety degrees to provide full extension. In the TV position as shown in FIG. 6, the upper support link 92 and lower support link 94 are pivotably coupled at their respective forward ends to the footrest bracket 60 at pivots 116 and 118 respectively. Footrest link 84 has a forward end, a rearward end, and a center portion therebetween. The rearward end of the footrest link 84 is pivotably coupled to the footrest bracket 60, and the center portion to the extension link 86 at pivot 115. The uppermost edge of the footrest bracket 60, and the forward end of the footrest link 84 attaches to the ottomans 16, 18. In addition, the extension link 86 functions to rotate the footrest link 84 about the link 117 such that the foot support ottoman 16 is generally horizontal in the TV position. It should be understood, that while the above description of the mechanism 10 has been described with respect to a single chair 40, the mechanism is designed to operate within all types of seating units, including within central sections of sectional seating arrangements.

Figure 5:
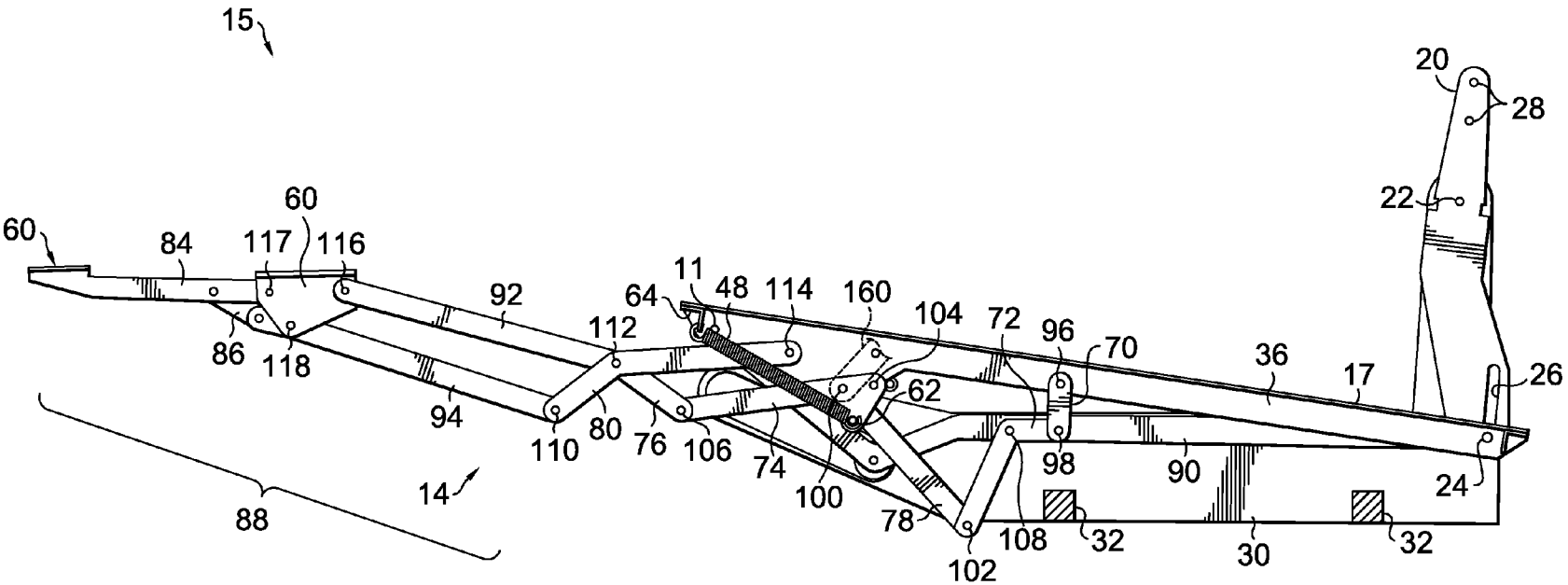
FIG. 5 is a view similar to FIG. 4, but in a TV position.

The operation of the recliner mechanism 10 within the reclining chair 40, and particularly of the opposed recliner structures 15, is depicted in FIGS. 4-6, which correspond to the sequence shown in FIGS. 1-3. In FIG. 1, the recliner structure 15 is shown in the closed position, with the back arm 20 generally vertical, the footrest linkage assembly 14 fully retracted within the stationary base 34, and the seat rail 36 substantially horizontal. As the user occupies the reclining chair 40, user weight and the weight of the seat cushion 50, produces a horizontal force on the upper part of the back arm 20, and a vertical downward force on the seat rail 36. The horizontal force causes a clockwise (as viewed in FIGS. 4-6) torque about the back pivot 22 and results in a forward force at the pivot 109. However, in the closed position the pin 24 resides in the upper opening of the sequence slot 26 at a vertical distance from the pivot 109, where the triangular geometry of the seat rail 36, the carrier bracket 90, and the lower part of the back arm 20 blocks rotation about the back pivot 22.

The vertical force of the user weight on the seat rail 36 is distributed to the main pivot 11 and pivot 96 of the seat pivot link 70. Main pivot 11 is statically held in position by the carrier bracket 90 and provides a point of rotation for the seat rail 36. Vertical force is transferred downward through the seat pivot link 70 to an upper end of the seat raise link 72 creating a clockwise torque about pivot 108. The clockwise moment produces an upward force at pivot 102 that is transferred through the over-center link 78 to the drive location 100. As shown in FIG. 7, the drive location 100 is located slightly above the over-center axis 150. As such, the upward force from the over-center link 78 forces the upper drive link 74 up against the upper stop 21. The tension device 48 acts on the rearward spring couple 62 at a vertical distance above pivot 104 generating a horizontal force. The horizontal force and the weight of the user combine to create a containing force that resists extension of the footrest assembly linkage 14.

In use, the user of the reclining chair 40 can adjust the recliner mechanism 10 from the closed position to the TV position by exerting a rearward force on the upper end of the actuator lever 160. The rearward force creates a torque about pivot 124, and produces a downward force on the drive location 100. Only a slight rearward force from the user brings the containing force and the torque about pivot 125 into equilibrium. As the equilibrium is overcome by the extension torque, the upper drive link 74 rotates clockwise about pivot 104 causing the drive location 100 to move downward and pass through the over-center axis 150. In this configuration, the upward force from the over-center link 78 (produced by user weight) applied upon the drive location 100, acts to produce a clockwise torque on the upper drive link 74 about pivot 104. Then, the vertical force created mainly by the user weight no longer resists, but assists, the extension of the footrest linkage assembly 14 into TV position. The clockwise torque is transferred to the lower drive link 76 at pivot 106 that in turn forces the forward linkage structure 88 forward at pivot 112 of extension arm 80. Extension arm 80 rotates clockwise about pivot 114, as such, extending pivotably interconnect links 60, 84, 86, 92, and 94 until the footrest link 84 is disposed generally horizontal as shown in FIG. 5. Accordingly, as the drive location 100 passes through the over-center axis 150, the seat lowering link 72 is allowed to rotate clockwise about pivot 108. The clockwise motion brings the seat pivot link 70 downward, which in turn allows the seat rail 36 and seat 50 to rotate downwardly about the main pivot 11. The downward rotation of the seat rail 36 is constrained and stopped when the pin 24 contacts a bottom edge of the lower end of the sequence slot 26 bringing the seat 50 to a rearward inclination angle.

The reclining chair 40 is adjusted from the TV position to the fully reclined position when the user exerts a rearward force on the upper part of the back arm 20. The rearward force provides a torque about the back pivot 22 and causes the lower part of the back arm 20 to push forward on the pin 24 and on the pivot 109. In the TV position, the static triangular geometry defined by the vertical distance between the pin 24 and the carrier pivot 109 is diminished to a pivotable point allowing rotation of the back arm 20. The forward motion of pivot 109 moves carrier bracket 90 and seat rail 36 forwardly. This causes the recliner structures 15 to be guided forwardly and upwardly by the roller 68 within slot 66. The fully reclined position is achieved as the progress of the roller 68 is stopped by contacting a front edge of the roller slot 66, as best seen in FIG. 6. User weight provides a constant horizontal force on the upper part of the back arm 20 holding the reclining chair 40 in the fully reclined position. As the mechanism moves to the fully reclined position, the pin 24 moves slightly upward within slot 26. In a preferred embodiment of the fully reclined position, the upper part of the back arm 20 extends only about six inches rearward of the back 54 to provide for the space saving utility of the reclining chair 40.

In the fully reclined position, the back arm 20 is oriented in a rearward inclination; accordingly, the sequence slot 26 is oriented at a rearward angle. The rearward angle of the sequence slot 20 blocks a path of rotation of the pin 24 about main pivot 11, as such, capturing the pin 24 in the lower opening of the sequence slot 26 and restricting rotation of the seat rail 36. The inability of the seat rail 36 to rotate about main pivot 11 in the fully reclined position prevents the footrest linkage assembly 14 from retracting to the closed position.

Adjusting from the fully reclined position requires the user to lean forward and release a horizontal force on the upper portion of the back arm 20. The weight of the footrest link assembly 14, carrier bracket 90, and seat rail 36 overcomes the rolling friction of the roller 68 and the recliner structure 15, save the back arm 20, moves rearward and downward as a unit along the trajectory of the roller slot 66. The TV position is achieved as the progress of the roller 68 is stopped by contacting a rear edge of the roller slot 66, as best seen in FIG. 5.

Adjusting from the TV position to the closed position requires the user to provide sufficient downward force on the ottomans 16, 18 as to overcome the downward force of the user's weight upon pivot 96 and the force of the tension device 48. The necessary downward force on the ottomans 16, 18 to overcome the opposed forces is minimal, as such, user operation of the actuator lever 160 is not required. As shown in FIG. 5, a downward force upon the forward linkage structure 88 is carried through the lower drive link 76 to provide a counter-clockwise torque on the upper drive link 74 about pivot 104. The upper drive link 74 will then rotate clockwise provided the downward force of the user weight as carried through links 70, 72, 78 is overcome. However, the downward force of the user's weight assists the rotation of the upper drive link 74 when the drive location 100 passes upward through the over-center axis 150. In this configuration, as shown in FIG. 7, the tension device adds to the force from the over-center link 78 (produced by user weight) applied upon the drive location 100, and acts to produce a counter-clockwise torque on the upper drive link 74 about pivot 104. As a result, the vertical force created mainly by user weight no longer resists, but assists, the retraction of the footrest linkage assembly 14 into closed position. The counter-clockwise moment is transferred to the lower drive link 76 at pivot 106 that in turn forces the forward linkage structure 88 rearward at pivot 112 of extension arm 80. Extension arm 80 rotates counter-clockwise about pivot 114, as such, retracting pivotably interconnected links 60, 84, 86, 92, and 94 until the footrest link 84 is disposed beneath the seat 50 as shown in FIG. 4.

Figure 8:
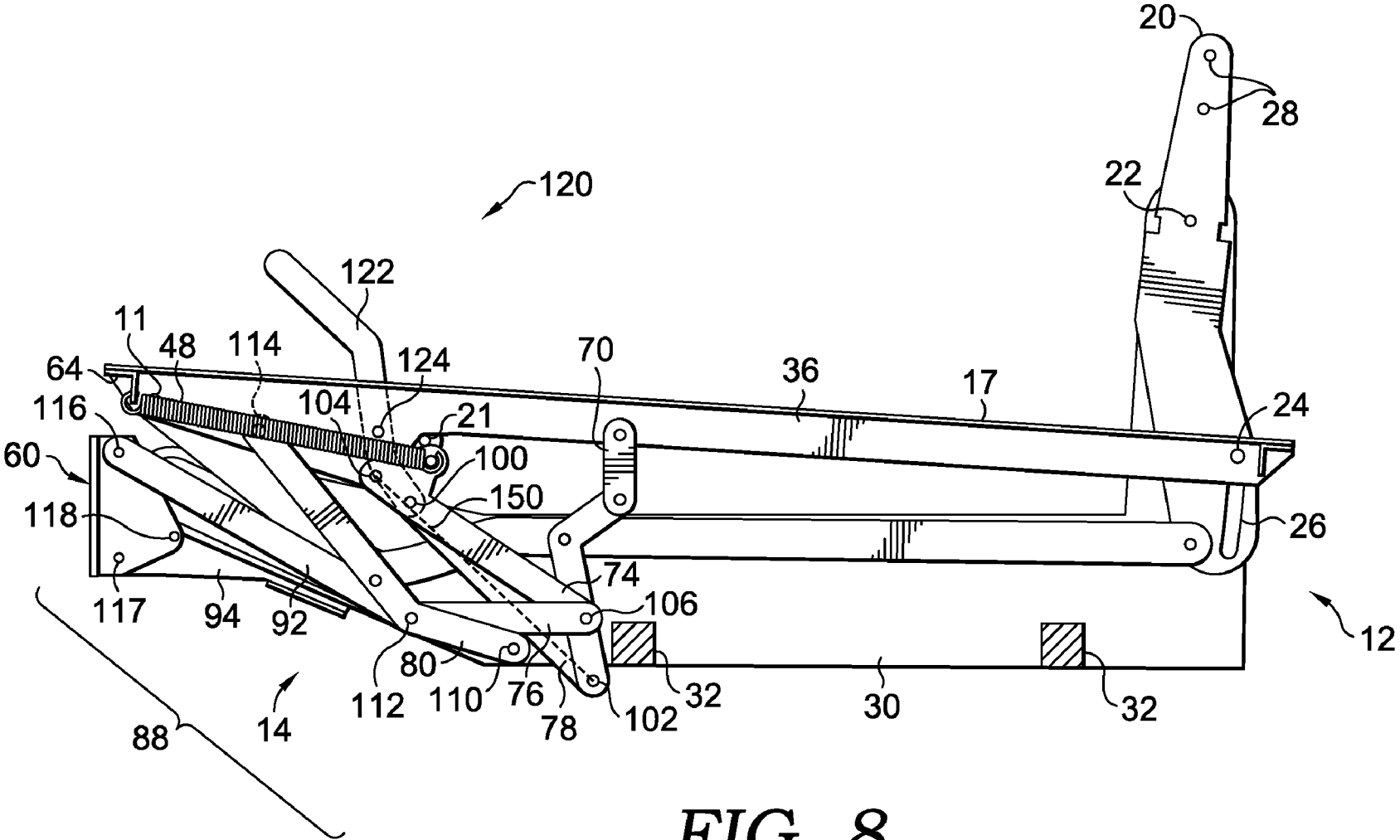
FIG. 8 is a view similar to FIG. 4, but with a lever actuator assembly.

Different embodiments can be used for actuator lever 160. As shown in FIG. 8, one configuration is a lever actuator assembly 120. Lever actuator assembly 120 utilizes an operator lever 122. The operator lever 122 is coupled at a lower portion to the drive location 100. An upper portion of the operator lever 122 extends above the seat rail 36. In operation, the user exerts rearward force upon the upper portion of the operator lever 122, creating a clockwise rotation about pivot 124, and carried through to the drive location 100, as such, adjusting the recliner structure 15 from the closed to TV position.

Figure 9:
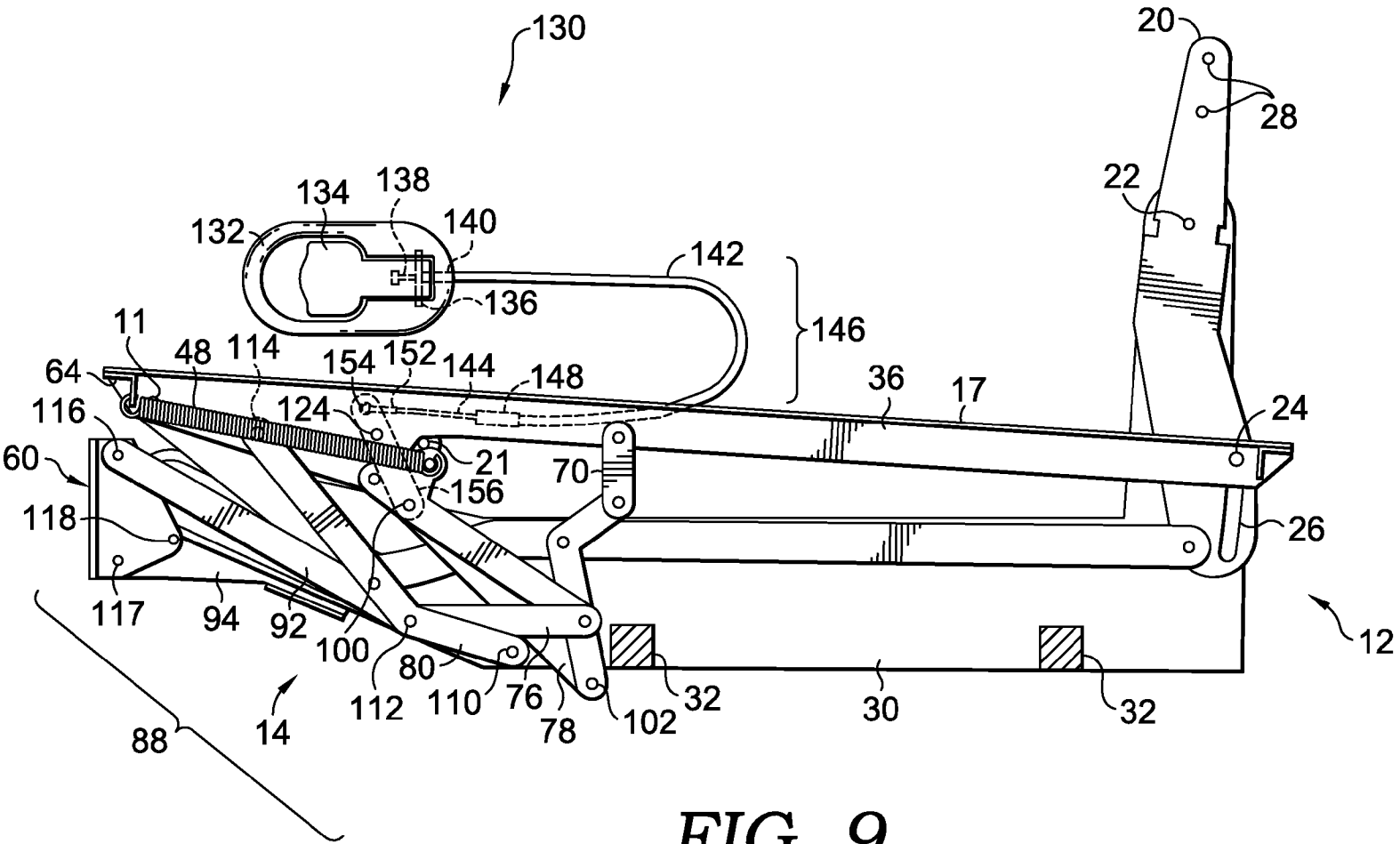
FIG. 9 is a view similar to FIG. 4, but with a cable actuator assembly.

As shown in FIG. 9, another actuation mechanism is a cable actuator assembly 130. Cable actuator assembly includes a handle bracket 132, a release handle 134, a pivot pin 136, a drive member 156, and a cable assembly 146.

Handle bracket 132 and release handle 134 are pivotably coupled by the pivot pin 136. Cable assembly 146 has a conduit 142 with an external end 140 and an internal end 148, and a cable wire 144 with a lever end 152 having a pin 154 and a handle end 138, wherein ends 152, 138 extend from the conduit 142. The cable wire 144 is allowed to move axially within the conduit as is known to those of skill in the art. The handle end 138 is coupled to the mounting section of release handle 134 below pivot pin 136. The external end 140 of conduit 142 is coupled to the handle bracket 132, such that the conduit 142 is fixed and cannot move.

A length of cable wire 144 is provided to extend the cable assembly 146 to the drive member 156. Cable assembly 146 may be held in place in a desired location through various attachment mechanisms or grommets. The internal end 148 of conduit 142 is fixedly connected to the seat rail 36 by any suitable fasteners which are well known in the furniture manufacturing industry. Drive member 156 acts as the actuator lever 160, and is pivotably coupled at pivot 124. Member 156 has an upper end and a lower end. Drive member 156 is formed with a hole at the upper end, which facilitates connection to the pin 154 of lever end 152 of cable wire 144. In addition drive member is coupled to the drive location 100 on the upper drive link 74.

In use, a user of reclining chair 40 may pull the release handle 134 to adjust the reclining mechanism 10 from the closed to the TV position. Pulling the release handle 134 rotates the handle about pivot pin 136, which engages handle end 138 of cable wire 144 to pull the cable through conduit 142. This in turn pulls the lever end 152 rearward, and rotates drive member 156 clockwise about pivot 124. As drive member 156 rotates, it pushes the drive location 100 forward triggering the footrest linkage assembly 14 to extend into the TV position.

Although two different configurations of the release mechanism have been shown, it should be understood that other release mechanisms could be used, and that the invention is not limited to those release mechanism shown and described.

Persons familiar with the field of the invention will realize that it may be practiced by various devices which are different from the specific illustrated embodiment. Therefore, it is emphasized that the invention is not limited only to this embodiment but is embracing of a wide variety of mechanisms which fall within the spirit of the following claims.

What is claimed:

1. A seating unit, comprising:

a base with opposed arms;

a seating support surface extending between the arms, an ottoman;

a seat rail connected to the seating support surface;

an ottoman linkage assembly coupling the seat rail and the ottoman, the linkage assembly adapted to move the ottoman from a closed position with the ottoman generally vertical and beneath the seating support surface and an extended position with the ottoman generally horizontal and forward of the seating surface;

a drive link having a first end pivotably coupled to the seat rail at an upper pivot and having a drive attachment location below the upper pivot, and having a second end pivotably coupled to the ottoman linkage assembly;

an over-center link having a first end pivotably coupled to the drive link at the drive attachment location and having a second end opposite said first end, said second end having a lower pivot point, wherein the upper pivot and lower pivot point define an over-center axis; and a drive lever pivotably attached to the seat rail and having an upper portion adapted to be actuated by a user, and a lower portion pivotably attached to the drive link and the overcenter link at the drive attachment location, wherein the drive lever can be pivoted to translate the drive attachment location through the over-center axis to enable movement of the drive link, triggering movement of the ottoman linkage assembly moving the ottoman between the closed position and the extended position.

2. The seating unit of claim 1, the base having a plurality of legs wherein the legs support the opposed arms above an underlying surface and wherein the ottoman linkage assembly, drive link, and over center link are located below the seating support surface and above the upper-most part of the legs.

3. The seating unit of claim 1, wherein the seating support surface supports a T-cushion seat.

4. The seating unit of claim 1, further comprising an extension-resistant mechanism, having a forward and rearward end, that is coupled to the seat rail at the forward end and to the drive link at the rearward end, the mechanism resisting actuation of the drive lever.

5. The seating unit of claim 4, wherein the extension-resistant unit is a tension spring.

6. A reclining mechanism for a seating unit adapted to move the seating unit between closed, extended and reclined positions, the seating unit having a base, a seat, an extendable ottoman, and a back, the mechanism comprising:

a pair of side arm brackets coupled to the base, each bracket having a generally vertical back support section and a forward section with a slot disposed therein, the slot being angled such that the slot is lower toward the back of the chair;

a pair of seat rails, each pivotably coupled on a first end to a forward end of the base, the seat rails coupled to the seat;

back support means for pivotably supporting the back of the chair on the side arm brackets, the back support means slidably coupled the seat rails;

a pair of brackets extending from the back support means to the front of a respective seat rail;

a roller rotatably coupled to each of said pair of brackets, said roller positioned with the slot in an adjacent side arm bracket, and wherein the roller is positioned in the lower part of said slot when the seating unit is in the closed and extended positions and wherein the roller is positioned in the upper end of said slot when the seating unit is in the reclined position, the roller and the slot defining movement of the seat forwardly as the seating unit moves from the extended position to the reclined position;

a drive link having a first end pivotably coupled to the seat rail at an upper pivot and having a drive attachment location below the upper pivot, and having a second end pivotably coupled to the ottoman linkage assembly;

an over-center link having a first end pivotably coupled to the drive link at the drive attachment location and having a second end opposite said first end, said second end having a lower pivot point, wherein the upper pivot and lower pivot point define an over-center axis; and a drive lever pivotably attached to the seat rail and having an upper portion adapted to be actuated by a user, and a lower portion pivotably attached to the drive link and the over-center link at the drive attachment location, wherein the drive lever can be pivoted to translate the drive attachment location through the over-center axis to enable movement of the drive link, triggering movement of the ottoman linkage assembly moving the ottoman between the closed position and the extended position.

7. The reclining mechanism of claim 6, wherein the back support means restrains movement of the seat when the seating unit is in the closed position.

8. The reclining mechanism of claim 7, further comprising an ottoman linkage assembly coupling the seat rail and the ottoman, the linkage assembly adapted to move the ottoman from the closed position where the ottoman is generally vertical and beneath the seat and the extended position where the ottoman is generally horizontal and forward of the seat.

9. The reclining mechanism of claim 6, further comprising an extension-resistant mechanism, having a forward and rearward end, that is coupled to the seat rail at the forward end and to the drive link at the rearward end, the mechanism resisting actuation of the drive lever.

* * * * *